United States Patent [19]

Rafalko

[11] Patent Number: 4,788,726

[45] Date of Patent: Dec. 6, 1988

[54] PORTABLE INFANT PROTECTIVE PAD

[75] Inventor: John S. Rafalko, Arvada, Colo.

[73] Assignee: Gold, Inc., Denver, Colo.

[21] Appl. No.: 114,337

[22] Filed: Oct. 28, 1987

[51] Int. Cl.[4] ..... A47D 5/00; A47D 21/08; A47D 7/00

[52] U.S. Cl. ..... 5/93 R; 5/424; 5/425

[58] Field of Search ..... 5/431, 448, 425, 424, 5/427, 420, 419, 94, 474, 93 R; 297/219

[56] References Cited

U.S. PATENT DOCUMENTS

| | | | |
|---|---|---|---|
| D. 259,458 | 6/1981 | Fuller et al. . | |
| 2,366,680 | 1/1945 | Valentine et al. . | |
| 2,483,223 | 9/1949 | Moss . | |
| 2,644,173 | 7/1953 | James . | |
| 3,165,355 | 1/1965 | Hitchock et al. . | |
| 3,366,294 | 1/1968 | Stephenson | 224/29 |
| 3,803,646 | 4/1974 | Newbrowski | 5/93 R |
| 4,173,048 | 11/1979 | Varaney | 5/436 |
| 4,383,713 | 5/1983 | Roston | 297/219 |
| 4,434,513 | 3/1984 | Welch . | |

FOREIGN PATENT DOCUMENTS

| | | | |
|---|---|---|---|
| 195057 | 1/1958 | Fed. Rep. of Germany . | |
| 11306 | of 1895 | United Kingdom | 5/434 |

OTHER PUBLICATIONS

Brochure published 1977 by Action for Child Transportation, Inc., entitled "This is the Way the Baby Rides". Advertising Brochure entitled "The Original Head Support" published 1980 by Little Sun.

*Primary Examiner*—Alexander Grosz
*Attorney, Agent, or Firm*—Chester E. Martine, Jr.

[57] ABSTRACT

A pad for protecting an infant is provided with a panel having opposite sides that are spaced to provide a flat support surface large enough for receiving the infant, such as a sleeping or supine infant, to enable changing of the clothes worn by the infant, for example. The panel has a continuous edge that is defined by the terminus of the sides and that extends away from the support surface. An endless roll having a relatively uniform cross-sectional shape extends around the edge to completely enclose the flat support surface. The roll includes an elongated blanket that is multiple-folded into a serpentine cross-sectional configuration. A cover surrounds and holds the elongated pad in such serpentine cross-sectional configuration. The cover has overlapping elongated ends. A binding joins the overlapping ends of the cover of the roll and the edge of the panel in overlapping relationship so that the surrounded serpentine, cross-sectional configured portion of the roll extends upwardly from the edge of the panel to completely enclose the flat support surface. The roll as so configured is self-supporting in a generally vertical position and tends to resist movement of the infant off the flat support surface.

7 Claims, 2 Drawing Sheets

PORTABLE INFANT PROTECTIVE PAD

BACKGROUND OF THE INVENTION

1. Field of the Invention

The present invention relates to the field of infant accessory products and more particularly to the field of pads for protecting infants.

2. Description of the Prior Art

In the past, various pads have been provided for protecting infants. Some have been designed specifically for protecting the head of an infant, as for example that shown in U.S. Pat. No. 4,434,513. In that patent a tapered roll extends around only the upper end of a panel that is placed in an infant car seat or that may be placed on a horizontal surface.

Other pads have been provided with a hinged panel that receives an infant and that is provided with padding that closely surrounds the infant's body. Such a pad shown in U.S. Pat. No. 3,366,294 has solid foam padding having a cylindrical cross-section.

General purpose pads having an annular shape are shown in U.S. Pat. No. 2,366,680, wherein a disk-like filling member is bent over once into itself and received in an envelope. The bent member sits flat or generally horizontally on a rigid carrier.

Liquid impervious sheets, such as that shown in U.S. Pat. No. 2,644,173, have been provided with inflatable tubes that surround the sheet. Such sheets are used with a separate washable cover that has an opening to allow access to the inflation valve of the inflatable tube.

SUMMARY OF THE INVENTION

In contrast to the prior art in which inflatable tubes are provided, or in which loose fibers or single folded members have been used as rolls around a base member, the preferred embodiment of the present invention provides a protective pad for an infant in which an infant support panel is completely surrounded by a roll member having a serpentine cross-sectional configuration to achieve the following objects.

Initially, the infant protective pad may be used in either of two positions, the first of which supports the infant on a quilted surface that is surrounded by the roll member to protect the infant, such as when the infant's clothes are being changed.

Another object of the present invention is to provide a reversible infant protective pad in which the surface that is normally the bottom and that may be placed on a changing table, for example, is made of waterproof material, such that when the protective pad is inverted and the roll member is placed on the changing table, and the infant is placed on the waterproof material, the roll member keeps the outer edges of the inverted protective pad in an upper position so that liquid is retained in the center of the protective pad.

A further object of the present invention is to provide an infant protective pad in which an endless roll member completely surrounds a support panel for receiving an infant, and wherein the endless roll is secured to the support panel so that a serpentine cross-sectional configuration of the roll extends upwardly from the support panel in the form of multiple overlapping layers that encircle the support panel and protect the infant.

With these and other objects in mind, a protective pad for an infant in accordance with the present invention is provided with a panel having opposite sides that are spaced to provide a flat support surface large enough for receiving the infant, such as a sleeping or supine infant, to enable changing of the clothes worn by the infant, for example. The panel has a continuous edge that is defined by the terminus of the sides and that extends away from the support surface. An endless roll having a relatively uniform cross-sectional shape extends around the edge to completely enclose the flat support surface. The roll includes an elongated pad having a serpentine cross-sectional configuration and an enclosure that surrounds and holds the elongated pad in such serpentine cross-sectional configuration and that has overlapping elongated ends. A binding secures the roll to the panel so that the roll surrounds the flat support surface. The binding joins the overlapping ends of the enclosure of the roll and the edge of the panel in overlapping relationship so that the surrounded serpentine, cross-sectional configured portion of the roll extends upwardly from the edge of the panel to enclose the flat support surface. The roll as so configured is self-supporting in a generally vertical position and tends to resist movement of the infant off the flat support surface.

BRIEF DESCRIPTION OF THE DRAWINGS

Other objects, features and advantages of the present invention will be apparent from an examination of the following detailed descriptions which include the attached drawings in which.

DETAILED DESCRIPTION OF THE PREFERRED EMBODIMENT

Figure 1:
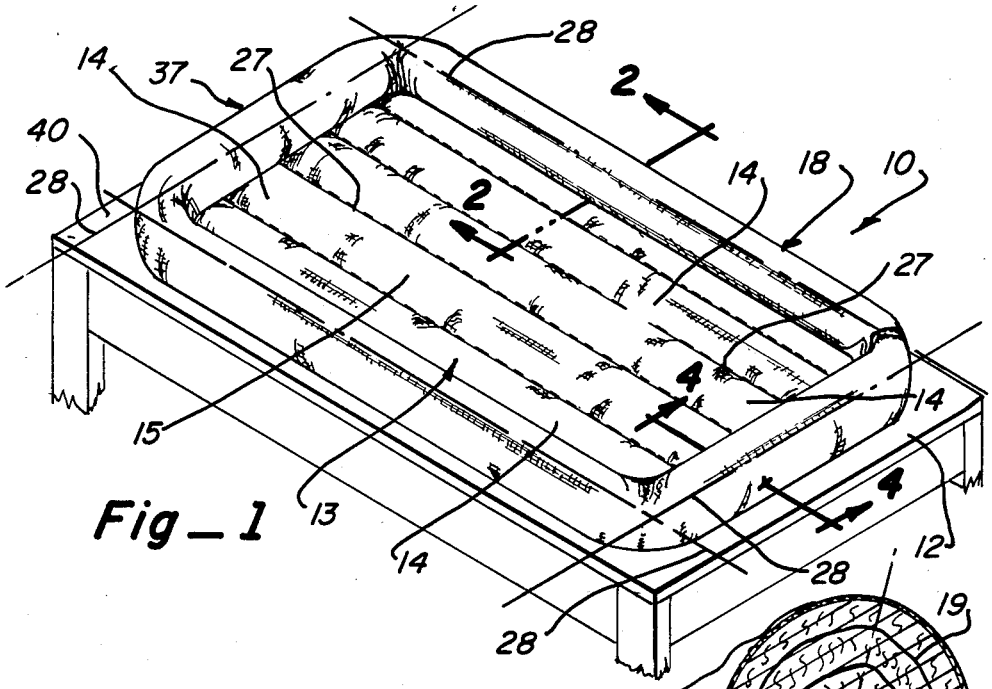
FIG. 1 is a perspective view of the protective pad of the present invention shown supported on a surface such as a changing table and showing a central support surface of a panel for receiving an infant and an endless roll extending completely around the support surface.
Figure 4:
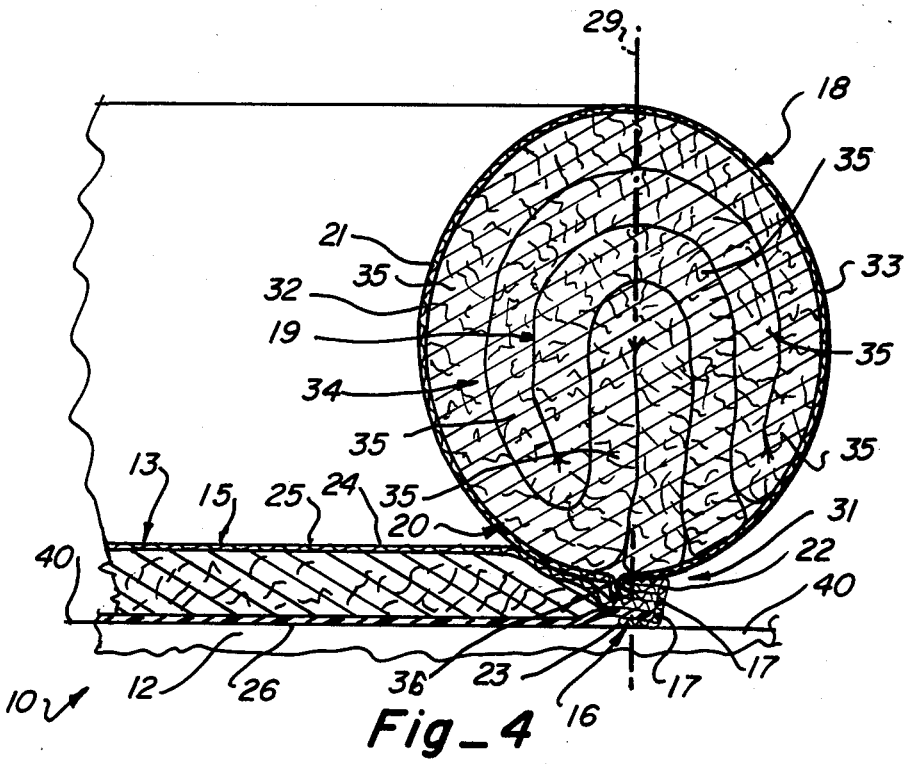
FIG. 4 is a cross-sectional view taken along line 4—4 of FIG. 1 showing a binding securing the endless roll to the panel and showing in detail the endless roll formed from an elongated pad having a serpentine cross-sectional configuration.
Figure 5:
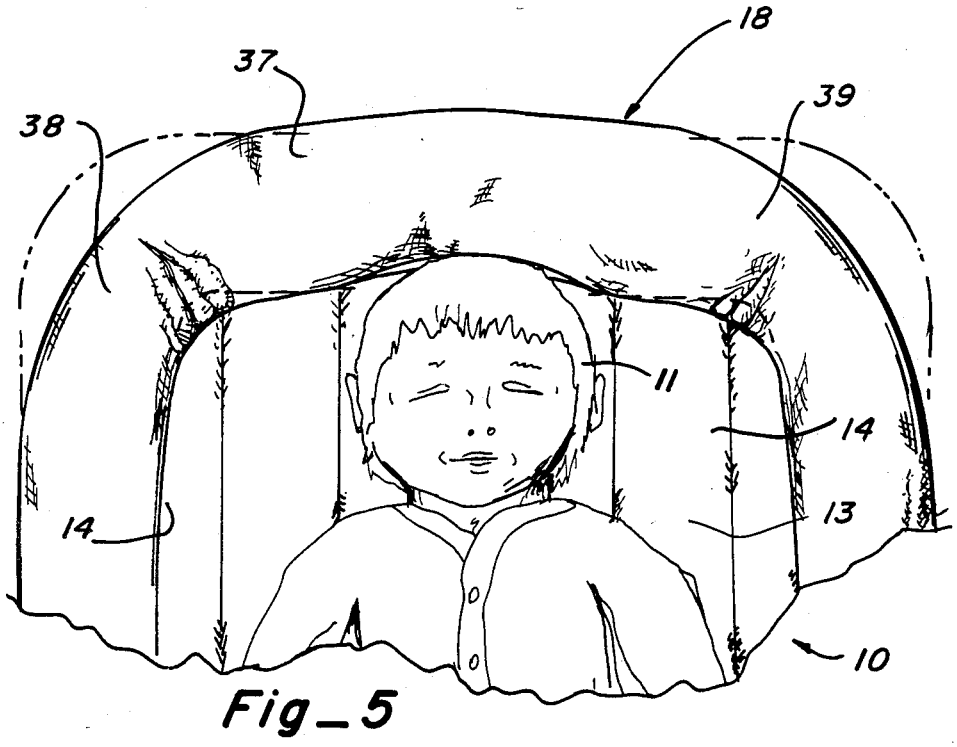
FIG. 5 is a plan view of the protective pad of the subject invention showing the infant's head engaging one end of the endless roll and causing the roll to bow outwardly and in turn drawing the adjacent opposite sides of the roll inwardly to provide a force on the infant's head tending to resist further movement of the infant off the central support surface of the panel.

A protective pad 10 constructed in accordance with the principles of the present invention is shown in FIG. 1 for use with an infant 11 (FIG. 5). The protective pad 10 is adapted to be placed on a horizontal surface such as that provided by a table 12 or a bed or the floor of a room (not shown). The protective pad 10 is provided with a panel 13 having opposite sides 14—14 spaced to provide a flat support surface 15 large enough for receiving the infant 11. The panel 13 has a continuous edge 16 (FIG. 4) that is defined by the terminus 17 of each side 14 and that extends away from the support surface 15. An endless roll 18 having a relatively uniform cross-sectional area extends around the continuous edge 16 to completely enclose the flat support surface 15.

Referring to FIG. 4, the roll 18 is formed from an elongated pad 19 having a serpentine cross-sectional configuration 20. The roll 18 includes an enclosure 21 for surrounding and holding the elongated pad 19 in such serpentine cross-sectional configuration 20. The enclosure 21 has overlapping elongated ends 22. A binding 23 secures the roll 18 to the panel 13 so that the roll 18 surrounds the flat support surface 15. The binding 23 joins the ends 22 of the enclosure 21 and the edge 16 of the panel 13 in overlapping relationship so that the surrounded serpentine, cross-sectional configuration 20 of the roll 18 extends upwardly from the edge 16 of the panel 13 and overlies a portion 24 of the flat support surface 15. The serpentine cross-sectional configuration 20 and the endless construction of the roll 18 render the roll self-supporting in a generally upright or vertical position so that the roll 18 tends to resist movement of the infant 11 off the flat support surface 15.

Referring now in detail to FIG. 1, the protective pad 10 is shown supported on the table 12. The pad 10 is suitable for use on the floor, a bed or even on unclean surfaces due to the construction of the panel 13 as described below. The infant 11 shown in FIG. 5 may be placed on its back (in a supine position) on the panel 13 as for changing its diaper or other clothes. The protective pad 10 is also intended to protect a sleeping infant 11 from birth to from three to four months in the pre-crawling stage of infant development. In the case of the sleeping infant 11, the pad 10 is place on the floor (not shown), for example, and the infant tends to move until it snuggles against a surface, such as the endless roll 18. The panel 13 is generally rectangular in shape and defines an area large enough to comfortably change the infant's clothes, for example.

Figure 2:
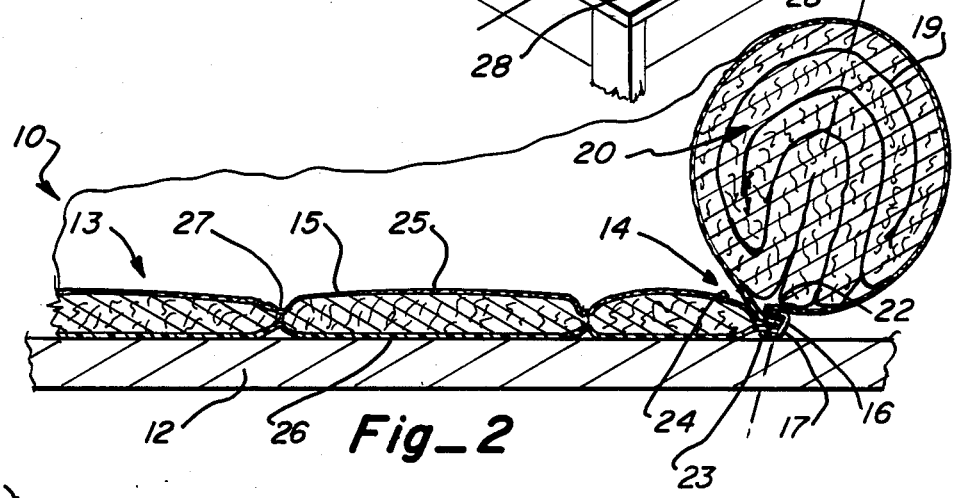
FIG. 2 is a cross-sectional view taken along lines 2—2 in FIG. 1 showing the panel quilted and formed by a soft upper layer of cloth and a lower waterproof layer and having padding between such layers, along with the endless roll secured to the outer edge of such panel.

Referring to FIG. 4, the panel 13 is constructed from a top quilted layer 25 of cloth or other soft material suitable for contact with the infant's skin. The layer 25 forms the flat support surface 15 on which the infant 11 may be placed, either on its stomach or in the supine position. The panel 13 has a lower layer 26 that is preferably formed from waterproof material such as nylon coated taffeta. Between the upper and lower layers 25 and 26 respectively there is provided a layer of padding or batting, which may be a six ounce polyester blanket. As shown in FIGS. 1 and 2, at spaced intervals across the width of the pad 10 stitching 27 is provided to form the quilting of the flat support surface 15. Such stitching 27 is shown along longitudinal lines that extend generally parallel, and may be in other desirable quilting patterns.

As shown in FIG. 1, the support surface 15 extends from the central part of the changing pad 10 outwardly to the sides 14—14 toward and under the roll 18. FIG. 4 shows the terminus 17 of each of the upper layer 25 and the lower layer 26 forming the edge 16 that extends continuously around the entire perimeter of the changing pad 10.

Referring again to FIG. 1, the changing pad 10 is shown including the endless roll 18 that extends along each of the sides 14—14 along a longitudinal axis 28 that defines a rectangle through the center of the endless roll 18. The roll 18 is shown in detail in FIG. 4 including the outer enclosure or cover 21 that may be formed from soft cloth or other material suitable to touch the skin of the infant 11. The endless roll 18 is also shown formed from the elongated pad 19. In its original shape, the elongated pad 19 may have a length equal to the length of the perimeter of the changing pad 10. This length in a preferred embodiment of the present protective pad 10 may be about 100 inches. The elongated pad 19 in its original shape has a width of about one yard and in a preferred embodiment is 35½ inches wide and is formed from four ounce batting or padding material in the form of a blanket.

As shown in FIG. 4, the original rectangular, flat elongated pad 19 is folded three times on itself to form the serpentine cross-sectional configuration 20. Such configuration 20 is shown in FIG. 4 having a transverse axis 29 and a dimension from a top 30 of the roll 18 to the bottom 31 of the roll 18 that exceeds the width thereof from an inner side 32 to an outer side 33. The cover 21 is effective to maintain the elongated flat pad 19 in the serpentine cross-sectional configuration 20. The ends 22 of the cover 21 are held at a generally right angle from the transverse axis 29 and are held in intimate overlapping relationship by the binding 23. The binding 23 thus closes the cover 21 in surrounding relationship relative to the configuration 20 of the endless roll 18.

As shown in FIG. 4, the ends 22 of the cover 21 overly the outer sides 14—14 of the panel 13 and terminate along the continuous edge 16 of the panel 13. The binding 23 is shown extending over the overlapped ends 22—22 of the cover 21, around the continuous edge 16 and underneath the lower layer 26. The binding 23 may be formed from a bias binding material and is stitched by a single needle lock stitch, for example, to secure the endless roll 18 to the panel 13. As shown in FIG. 4, the endless roll 18 is secured in this manner with the transverse axis 29 extending generally vertically relative to the horizontal upper support surface of the panel 13. FIG. 2 shows the portion of the roll 18 that extends along the longer ones of the sides 14—14 as being somewhat tipped outwardly from vertical, but still generally vertical.

The elongated pad 19 is shown in detail in FIG. 4 composed of a series 34 of sections 35, each of which is generally vertical and longer than the width of the endless roll 18 from the side 32 to the side 33. Those vertical sections 35 are somewhat compressed by the cover 21 and because they extend relatively tightly, continuously and completely around the perimeter of the panel 13, and because eight such sections 35 are formed by the elongated pad 19 in the serpentine cross-sectional configuration 20, the enclosure formed by the endless roll 18 has the self-supporting characteristic by which it maintains itself in the generally upright or vertical positions shown in FIGS. 2 and 4. Further, the endless roll 18 is capable or resisting the modest outward forces imposed thereon upon movement of the infant 11 in the pre-crawling stage of development.

The endless roll 18 is conveniently produced by cutting the elongated pad 19 to the above-described blanket dimensions. The elongated pad 19 is then triple folded into the configuration 20 shown in FIG. 4. With the elongated pad 19 held in that serpentine cross-sectional configuration 20, the cover 21 is placed over the elongated pad 19 and is preferrably secured by a stitch 36 so that the elongated pad 19 is firmly held in the configuration 20. The opposite longitudinal ends of the cover 21 are stitched together to form the endless roll 18. The ends 22—22 extend beyond the stitch 36 and are folded at right angles to the transverse axis 29 for positioning over the outer sides 14 of the panel 13.

As described above, the protective pad 10 may be used by placing the infant 11 on its back on the central support surface 15 to make the infant comfortable while its clothes, such as its diaper, are changed. During this process, or if the infant is placed on its chest as in a sleeping position, the infant may move from the central portion of the support surface 15 against the endless roll 18. As shown in FIG. 5, the head of the infant 11 may press into one end of the endless roll 18, such as the end 37. The infant's head forces the end 37 upwardly as shown in FIG. 5 or horizontally as shown in FIG. 1 and thus bends the end 37 and bends the adjoining sides 38 and 39 of the endless roll 18 causing such sides 38 and 39 to move inwardly under tension from their original position shown by dashed lines in FIG. 5. Because of such tension the endless roll 18 returns to its normal rectangular position shown in FIG. 1 when the infant 11 is moved to the center of the panel 13. Thus, the end 37 of the endless roll 18 tends to resist the force exerted by the head of the infant 11 such that the infant 11 sleeping on its chest will stop pushing and will thus be retained on the protective pad 10 when the pad 10 is placed on the floor, for example, to protect the infant 11 while it sleeps. When the pad 10 is used for changing the clothes of the infant 11 in the supine position, for example, the ends 37—37 and the sides 38 and 39 tend to help maintain the infant 11 on the flat upper surface 15.

Figure 3:
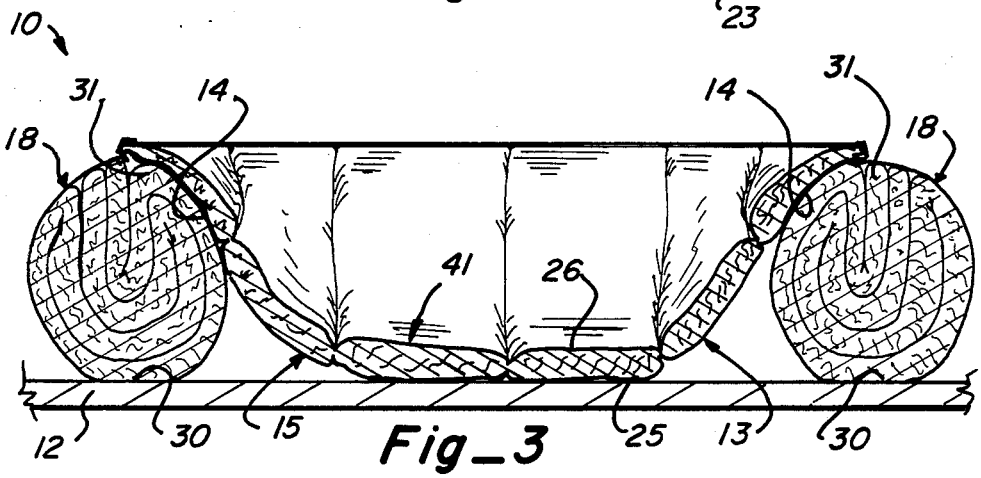
FIG. 3 is a cross-sectional view similar to that of FIG. 2 in which the protective pad has been inverted so that the roll maintains the opposite edges of the panel positioned above a portion of the panel that rests on the table such that liquid used in cleaning the infant or otherwise encountered in changing the infant's clothing is retained in a central area.

The changing pad 10 may also be used for changing the wet infant 11. In this case, the changing pad 10 is inverted from the position shown in FIG. 1 and is placed upside down as shown in FIG. 3. There, the bottom or lower layer 26 faces upwardly and the cloth top layer 25 becomes the bottom layer. Also, the top 30 of the roll rests on the table 12 and maintains the sides 14 of the panel above the upper surface 40 of the table 12. The central portion or surface 15 of the panel 13, however, hangs downwardly and engages the upper surface 40 of the table 12 to provide a depressed surface 41 for receiving the wet infant 11. Because the now upwardly facing lower layer 26 is formed from waterproof material, the infant 11 may be bathed or a soiled diaper can be removed from the infant without requiring washing of the entire pad. Rather, the liquid or other material may be wiped from the upwardly facing waterproof surface 41 of the lower layer 26 and the lower layer 26 dried so that after the infant 11 is dried the pad 10 can be inverted again and the infant 11 placed on the soft upper layer 25 to complete the changing of the clothes of the infant 11.

While the preferred embodiment has been described in order to illustrate the fundamental relationships of the present invention, it should be understood that numerous variations and modifications may be made to these embodiments without departing from the teachings and concepts of the present invention. Accordingly, it should be clearly understood that the form of the present invention described above and shown in the accompanying drawings is illustrative only and is not intended to limit the scope of the invention to less than that described in the following claims.

What is claimed is:

1. A protective pad for an infant, which comprises:

a panel having opposite sides spaced to provide a flat support surface large enough for receiving the infant, said panel having a continuous edge that is defined by the terminus of said sides and that extends away from said support surface;

an endless roll having a relatively uniform cross-section and extending around said edge to completely enclose said flat support surface, said roll including an elongated pad having a serpentine cross-sectional configuration and an enclosure, said enclosure surrounding and holding said elongated pad in said configuration and having overlapping elongated ends; and binding means for securing said roll to said panel with said roll surrounding said flat support surface, said binding means joining said ends of said enclosure of said roll and said edge of said panel in overlapping relationship with said surrounded serpentine cross-sectional configured portion of said roll extending upwardly from said edge of said panel to enclose said flat support surface, said pad being invertible to render said roll effective to support said edge of said panel while allowing said flat support surface to hang therefrom to form a depressed area that is lower than said edge.

2. A protective pad for an infant according to claim 1, wherein:

said panel has a bottom member underlying said support surface and said roll, said member being formed from waterproof material so that said depressed area can retain liquid;

3. A protective pad for an infant according to claim 1, wherein:

said elongated pad in said serpentine cross-sectional configuration has overlapped portions that are held adjacent each other by said enclosure; and said uniform cross-section of said roll is elongated in a direction generally perpendicular to said flat surface so that said overlapped portions of said pad in said serpentine cross-sectional configuration are self-supported in a generally vertical position.

4. A protective pad for an infant according to claim 3, wherein:

said elongated pad having a length about equal to the length of said continuous edge and an original width of about one third of said length, said pad being formed into said serpentine cross-sectional configuration by folding said width of said pad onto itself at least three times so that each of said overlapped portions of said serpentine cross-sectional configuration is longer than the overall width of said roll.

5. A protective support pad for surrounding an infant that is in a supine position, comprising:

a panel having a central surface for supporting the infant and having a continuous edge spaced from said central surface to provide room between the infant and said edge;

a roll extending along said edge to surround the infant, said roll being formed from an elongated flat pad that is folded back and forth onto itself to form a compact, serpentine-shaped roll member having a major dimension, said roll further including a cover for enclosing said roll member, said cover being provided with a flap extending therefrom generally perpendicular to the direction of said major dimension, said flap overlying and extending along said continuous edge of said panel with said major dimension of said roll member generally vertical and said roll having a portion extending inwardly toward said central surface; and a bias binding overlapping said flap and extending under said edge of said panel for attaching said roll to said panel so that said roll extends upwardly from the level of said central surface in position to be engaged by the infant and put under tension when the infant moves outwardly from said central surface, said pad being invertible to render said roll effective to support said edge of said panel while allowing said flat support surface to hang therefrom to form a depressed area that is lower than said edge.

6. A protective support pad according to claim 5, wherein:

said pad is adapted to be placed on a horizontal surface to surround the infant during changing of the infant's clothes;

said panel has a member forming the bottom of said central surface, said member is formed from waterproof material so that said depressed area can retain liquid;

7. A pad adapted to be placed on a horizontal surface for supporting an infant in a resting position, comprising:

an endless roll having a longitudinal axial dimension sufficient to define an area for receiving the infant, said roll having a transverse axial dimension extending generally perpendicular to said area, said roll being formed from an elongated flat pad that is folded back and forth onto itself to form a compact, serpentine-shaped roll member having said transverse axial dimension as a major dimension, said roll further including a cover for enclosing said roll member and holding said roll member in said compact serpentine shape, said cover being provided with a flap extending therefrom generally perpendicular to said major dimension;

a panel provided with a central upper surface for engaging the infant, said surface being dimensioned for reception in said receiving area, said panel having a waterproof lower surface and padding between said upper and lower surfaces, said panel having a continuous outer edge that extends outwardly from said receiving area;

said flap overlying and extending along said continuous outer edge of said panel with said major dimension of said roll member extending upwardly; and a binding sewn to said flap of said roll and to said outer edge and extending completely around said outer edge and completely along said longitudinal axial dimension of said roll to secure said roll on top of said panel and outside of said receiving area so that said major dimension of said roll surrounds the infant and said roll is placed in tension along said longitudinal axial dimension when the infant moves into contact with the roll.

* * * * *